United States Patent [19]

Ashton

[11] Patent Number: 4,571,906

[45] Date of Patent: Feb. 25, 1986

[54] SECTIONAL SCREENS

[75] Inventor: Geoffrey B. Ashton, Adelaide, Australia

[73] Assignee: Geoffrey Ashton Pty. Ltd., Adelaide, Australia

[21] Appl. No.: 540,446

[22] Filed: Oct. 11, 1983

[30] Foreign Application Priority Data

Apr. 19, 1983 [AU] Australia ..... PF8963

[51] Int. Cl.[4] ..... E04B 2/74

[52] U.S. Cl. ..... 52/239; 52/221; 52/238.1; 52/582; 52/809; 160/351

[58] Field of Search ..... 52/36, 220, 221, 238.1, 52/239, 241, 242, 809, 806, 582; 160/135, 351

[56] References Cited

U.S. PATENT DOCUMENTS

| | | | |
|---|---|---|---|
| 3,292,321 | 12/1966 | Vander Schans | 52/241 X |
| 3,428,108 | 2/1969 | Singer | 52/239 X |
| 3,713,257 | 1/1973 | Beavers | 52/36 |
| 3,871,153 | 3/1975 | Birum, Jr. | 52/239 X |
| 4,018,019 | 4/1977 | Raith et al. | 52/239 |
| 4,185,430 | 1/1980 | Gartung | 52/239 X |
| 4,344,475 | 8/1982 | Frey | 160/351 X |
| 4,391,073 | 7/1983 | Mollenkoph et al. | 52/239 X |

FOREIGN PATENT DOCUMENTS

| | | | |
|---|---|---|---|
| 2835952 | 3/1979 | Fed. Rep. of Germany | 52/36 |
| 2501332 | 9/1982 | France | 160/351 |
| 1600990 | 10/1981 | United Kingdom | 52/238.1 |

*Primary Examiner*—Donald G. Kelly
*Assistant Examiner*—Richard E. Chilcot, Jr.
*Attorney, Agent, or Firm*—Gordon L. Peterson

[57] ABSTRACT

A portable space divider screen which comprises a panel having a frame and infill means in same and means to join a panel to other panels and in which the infill means comprising cellular members with the cells containing sound-absorbent material, apertured wall members enclosing the infill means, and outwardly facing covers of sound-absorbing fabric over the said apertured wall members, and optionally a longitudinal slot in at least an upper face of the upper frame member and ducts to contain electrical wiring etc. longitudinally extending along the lower portion of the panel and having skirtings to cover the ducts to and support power outlets.

9 Claims, 3 Drawing Figures

SECTIONAL SCREENS

BACKGROUND OF THE INVENTION

It is customary in many cases where space divisions are required, such as room dividers, to have these of a nature such that they are movable and at the same time are self-supporting by using straight sections as well as curved sections so that by utilizing a number of sections of a screen appropriately various divisions of a space can occur with a final screen of a stable nature.

Screens of this type are already known and for instance according to an earlier screen manufactured by me and disclosed in Australian Registered Design No. 65,423, a series of sections were fitted together by utilizing connectors which were in the nature of plates with pairs of pins projecting therefrom, each pair being adapted to engage at least one of the sections of one screen with the other pair engaging adjoining section of the screen so that it was a simple matter to join both the top and bottom edges of the screens together in a stable manner. I was also the inventor of the invention disclosed in British Letters Pat. No. 1,600,990 in the name of Ashelwood Products Pty. Ltd., which deals with such screens.

Generally these screens are constructed of a material which has acoustic properties because the screens need to be of a sound-absorbing nature particularly as usually they are not ceiling height screens but merely project upwardly from a floor surface a required distance to give privacy to operators located on each side of such screens.

OBJECTIVES AND SUMMARY OF THE INVENTION

An object of the present invention is to provide certain improvements to screens of the type referred to above so as to achieve a high rigidity and good sound absorption and general acoustic properties.

A further object is to allow the panels of the screen to be joined by means of connectors in a manner somewhat similar to the earlier screens, and also to allow brackets of various type to be supported on the upper and lower edges and which in turn can support hanger strips on the panels at any position such as along the length of the panels so that the panels also become supporting means for shelving or the like.

The panels can be constructed conveniently to have at the top and bottom special configurations which include pin sockets and slots arranged to allow interconnection of panels and to carry hanger strips, and the main body of the panel is of cellular construction confined between upper and lower rails and end members and incorporates also electrical duct channels as well as skirtings of any required type.

The invention comprises basically a portable space divider screen which comprises a panel having at least upper and lower frame members and infill means extending at least partway between same and means to join a panel to other panels characterised by sockets at least at the top edge of the panel to receive pins on connectors to engage and interconnect panels, the infill means comprising cellular members with the cells containing sound-absorbent material, apertured wall members enclosing the infill means on both sides of the panel, and outwardly facing covers of sound-absorbing fabric over the apertured wall members.

To enable the invention to be fully appreciated an embodiment will now be described but it is to be realised that the invention need not necessarily be limited to this embodiment.

DESCRIPTION OF THE PREFERRED EMBODIMENT

Figure 1:
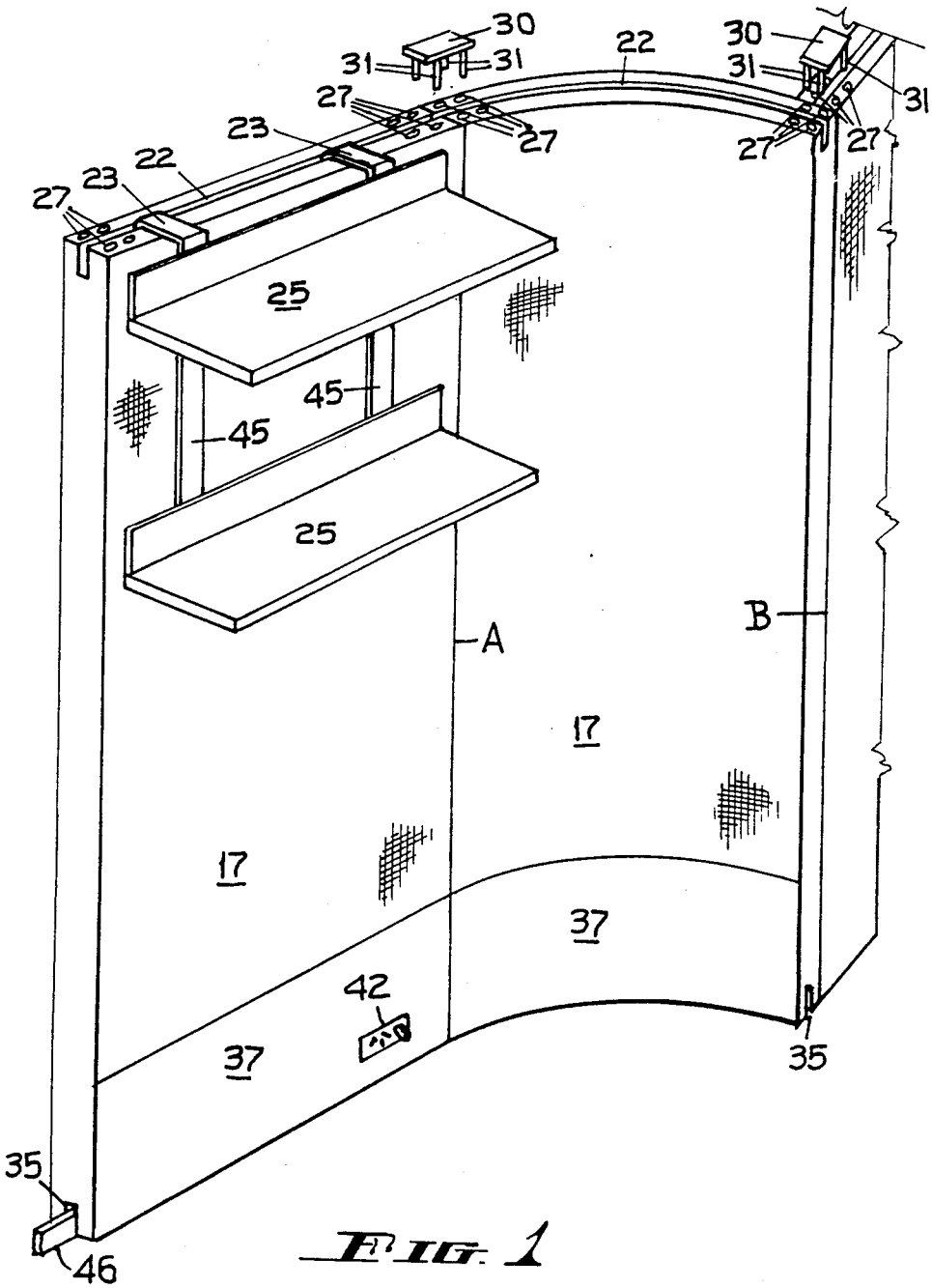
FIG. 1 is a perspective view of panels forming such a screen.
Figure 2:
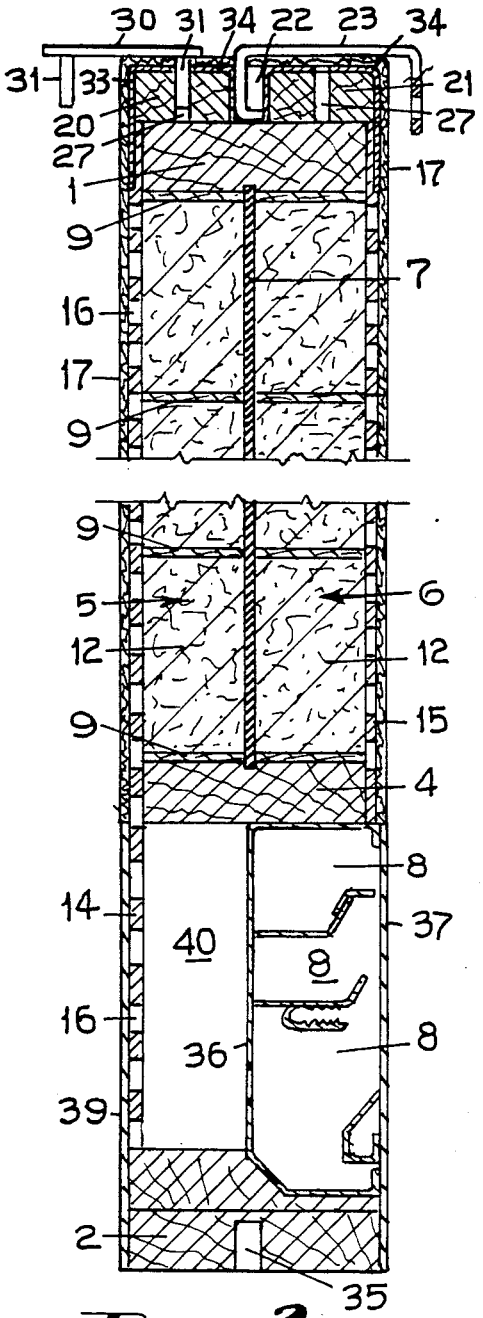
FIG. 2 is a cross-section of a panel to an enlarged scale showing a joining member and a support for shelving or the like, and FIG. 3 is a fragmentary view showing one end portion of such a panel with part of the fabric and the face member removed to show the internal construction.
Figure 3:
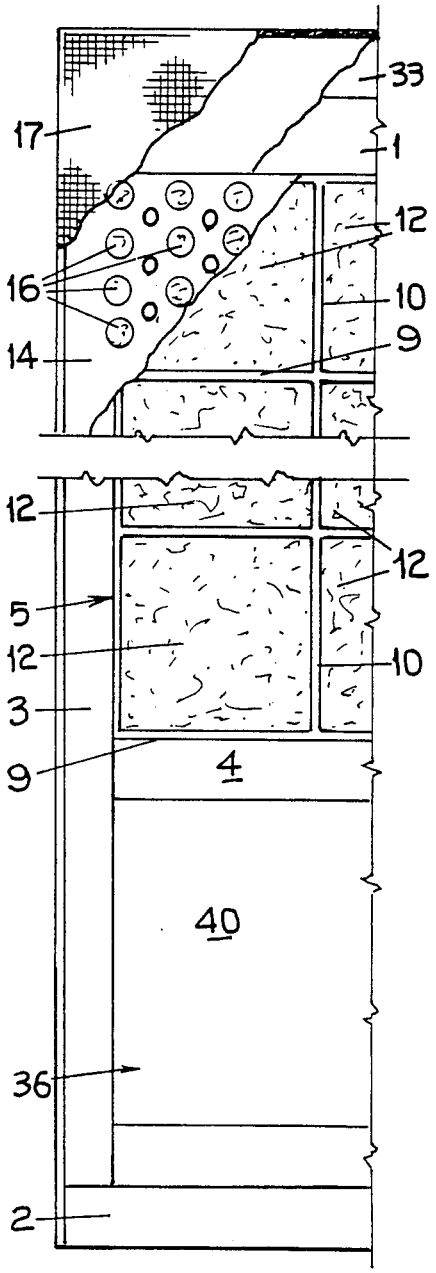

A frame is constructed to have a head rail 1 and a bottom rail 2 as well as end rails 3 and between the head rail 1 and an intermediate rail 4 are positioned cellular members 5 and 6. A septum 7 is formed between the head rail 1 and the intermediate rail 4 with one cellular member 5 on one side of it and the other cellular member 6 on the other side of it, these cellular members 5 and 6 extending generally over the whole of the screen excepting to allow for compartments 8 which can contain electrical wiring, phone lines etc. and to give access to the compartments 8 from the other side.

The cellular members 5 and 6 can be of what is known as the "egg-crate" construction that is horizontal and vertical ply wood members 9 and 10 respectively slotted to interconnect to form a series of compartments and these compartments are filled with insulating bats 12 for sound-absorbing purposes.

On the outside of these cellular members 5 and 6 are positioned acoustic wall members 14 and 15 preferably in the nature of ply wood perforated as at 16 to allow sound to be absorbed by the insulation bats 12 in the cells of the cellular members 5 and 6, and over these perforated wall members 14 and 15 is a covering of a sound-absorbing web 17 such as wool cloth.

The frame rails thus support an infill consisting of cellular members covered by acoustic wall members in turn covered by a web of sound-absorbing fabric.

At the top of each panel, engaged on the head rail 1, are a pair of longitudinally spaced strips 20 and 21 preferably constructed of custom wood or the like which form between them a longitudinal slot 22 which is adapted to be engaged by brackets 23 used to support hanger strips or the like when these are required at any particular location. In FIG. 1 these are shown as supporting shelving 25.

Each of these longitudinal strips 20 and 21 have sockets 27 formed in them arranged in pairs in a position where they can be engaged by connectors 30 having pins 31 to engage the sockets 27.

The longitudinal strips 20 and 21 are covered by a pair of longitudinally positioned channel-shaped reinforcing members 33 and 34 which can be of metal or the like which extend over the longitudinal strips 20 and 21 and line the slot 22 between the strips 20 and 21 and extend down over the outer edges of the strips 20 and 21 to cover the join between the strips 20 and 21 and the acoustic face members 14 and 15, the sockets 27 opening through those strips.

The lower edge of the screen, as said, has a bottom rail 2 and which has in it a longitudinal slot 35 used for locating the screen sections when required or for receiving the lower ends of the brackets 23 when both upper and lower location is required.

The bottom rail 2 can also have sockets corresponding to the sockets 27 in the head rail 1 so that they can be engaged by connectors 30 by inserting the pins 31 of the connectors 30 into the sockets and thus firmly locating the sections of the screen at the base as well as at the top, the connector being turned so that the pins 31 project upwardly.

Within the lower portion of each panel is a longitudinal service duct 36 of extruded aluminium or the like shaped to form a series of compartments for electrical or other wiring or services, service duct 36 extending approximately half way into the panel and being covered by a skirting member 37 which normally closes the openings of the compartments 8 and permit switches such as that shown at 38 to be mounted on the skirting member at appropriate intervals, the opposite side of the panel also having a skirting member 39 which is removable to give access to the service duct 36 through the space 40 between the skirting member 38 and the back of the service duct 36 which is appropriately perforated to allow leads to be taken out so that switches such as shown at 42 to allow outlets for power or phones or the like to be mounted on both sides of the skirting members when required.

Electrical ducts could of course be formed on both sides of the centre line of the panel or a single extruded aluminium or similar member could form the base of the screen preferably above the bottom rail to carry the skirtings for each side of the screen but variations of this type will be apparent without departing from the spirit of the invention.

The connectors 30 which are used for joining adjacent edges of panels, either where they are placed end to end as shown in FIG. 1 at the join A or at an angle as shown at B, or at any selected point intermediate each of the sections of the panels, comprise plates having pins 31 as referred to earlier herein, which pins are arranged to engage the sockets 27 which are arranged in pairs so that a connector having two pairs of pins 31 can have one pair engage a pair of the sockets 27 and similarly can engage a pair of sockets 27 on the abutting or adjoining sectional screen using two other pins 31.

The brackets 23 which engage the slot 22 can be shaped to have a portion housed in the slot 22 and to extend over the longitudinal strip 21 and have a configuration which will engage hanger strips 45 the hanger strips supporting shelving 25 as shown in FIG. 1, or other members to be supported by the panels.

It will be realised that, because of the existence of longitudinal slots 22 on at least the upper face of each of the sectional screens, positioning of hanger strips such as 45 is possible at any particular location along the length of each of the panels. The slots 35 at the base of the panel can be used to engage fixtures on the floor to locate the panels, or can engage joining battens 46 as shown in FIG. 1.

From the foregoing it will be realised that a simple and effective form of panel is provided which because of its cellular structure has very high rigidity and because of the use of insulating material in the cells of the structure and a perforated face member, has ideal sound absorption characteristics, and if such a screen is covered on its outside with a wool material or the like a very pleasing and highly effective unit results for each of the sections of the screen. These sections can be planar and of different height and generally different dimensions or can be curved to provide corner sections, the construction being one which lends itself ideally to forming different shapes and to then join the various shapes together in a very stable assembly when positioned on a floor or the like, and also to support shelving or the like.

I claim:

1. A portable space divider screen which comprises a panel having a head and bottom rails joined by end rails to form a perimeter frame, and an intermediate rail joined to infill means between the head rail and intermediate rail and means to join a said panel to other panels comprising pairs of sockets in at least the top rail of the panel to receive pins on connectors adapted to interconnect two panels, a septum between the said head and intermediate rails extending to said end rails, said infill means being over said septum and comprising multiple cellular members on each side of said septum with the cells containing sound absorbent material, perforated wall members enclosing the said infill means on both sides of the said panel, covers of sound absorbing fabric over the said perforated wall members, a longitudinal slot at the upper face of the upper rail and a longitudinal slot at the lower face of the bottom rail, ducts to contain electrical wiring longitudinally extending along between the bottom rail and the intermediate rail of the said panel, and skirtings also longitudinally extending along the lower portions of the said panel and disposed to cover the said ducts and adapted to support electrical switching and power outlets.

2. A portable space divider screen according to claim 1 characterised in that the said cellular members are spaced on each side of the said septum with the septum disposed centrally in the said panel, said septum forming a back to close the said cells of said cellular members.

3. A portable space divider screen comprising a head rail and a bottom rail joined by end rails extending to and to form a perimeter frame and including a rail intermediate the head and bottom rails, a septum extending between the top rail and the intermediate rail and joined to the end rails, multiple cellular members extending over the said septum on each side thereof with the cells filled with a sound-absorbing material, each of said cellular members having an outer face, acoustic perforated wall members extending over the outer faces of the said cellular members and having sound-absorbing fabric extending over the outer surface thereof, apertures in at least the top face of the head rail arranged in multiples, and adapted to be engaged by pins on joining connectors to join two divider screens together, a service duct formed between the said bottom rail and the said intermediate rail, and a removable skirting member closing the said service duct on at least one face thereof.

4. A portable space divider according to claim 3 including a longitudinal slot in the lower face of the lower rail adapted to be engaged by brackets adapted to carry shelves.

5. A portable space divider screen according to claim 3 characterised by a longitudinal slot in the top face of the panel and a longitudinal slot in the lower face of the lower rail adapted to be engaged by brackets adapted to carry shelves.

6. A portable space divider according to claim 5 wherein the space divider has outer faces and including shelves attached to brackets extending down the outer faces of the said space divider, the said brackets being shaped to have an upper portion extend over the top of the said upper rail and down to engage in the said longitudinal slot in the top face of the upper rail.

7. A portable space divider screen according to claim 6 characterised in that the said sound-absorbing fabric is wool cloth.

8. A portable space divider screen according to claim 6 wherein the upper rail has a top and is characterised by a pair of strips longitudinally extending across the top of the said upper rail said strips being spaced apart and joined to the head rail to form part thereof and to form between them the said longitudinal slot in the said head rail.

9. A portable space divider according to claim 8 characterised by reinforcing members extending across and down both sides of the said strips at the upper rail to line the said longitudinal slot and extend down beyond the outer faces of the strips to cover the outer edge portions of the said upper rail.

* * * * *

UNITED STATES PATENT OFFICE

CERTIFICATE OF CORRECTION

Patent No. 4,571,906 Dated Feb. 25, 1986

Inventor(s) Geoffrey B. Ashton

It is certified that error appears in the above-identified patent and that said Letters Patent are hereby corrected as shown below:

Column 4, line 38 after "bottom rail" insert -- extending to and --.

Column 4, line 38 after "end rails" delete -- extending to and --.

Signed and Sealed this

*Sixteenth* Day of *September 1986*

[SEAL]

*Attest:*

DONALD J. QUIGG

*Attesting Officer*

*Commissioner of Patents and Trademarks*